US009921523B1

(12) United States Patent
Terada

(10) Patent No.: US 9,921,523 B1
(45) Date of Patent: Mar. 20, 2018

(54) IMAGE FORMING APPARATUS AND METHOD FOR CONTROLLING DEVELOPER REFRESHING PROCESS THEREIN

(71) Applicants: KABUSHIKI KAISHA TOSHIBA, Tokyo (JP); TOSHIBA TEC KABUSHIKI KAISHA, Tokyo (JP)

(72) Inventor: Kyosuke Terada, Mishima Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/273,667

(22) Filed: Sep. 22, 2016

(51) Int. Cl.
*G03G 15/08* (2006.01)

(52) U.S. Cl.
CPC . *G03G 15/0894* (2013.01); *G03G 2215/0607* (2013.01)

(58) Field of Classification Search
CPC ..... G03G 15/0822; G03G 15/0844; G03G 15/0848; G03G 15/095
USPC ..... 399/27, 29, 253, 257
See application file for complete search history.

(56) References Cited

U.S. PATENT DOCUMENTS 7,515,844 B2 * 4/2009 Tanaka et al. ..... G03G 15/0853 399/27
8,472,823 B2 * 6/2013 Okubo et al. ..... G03G 15/0121 399/257

FOREIGN PATENT DOCUMENTS

JP 2008-233152 A 10/2008

* cited by examiner

*Primary Examiner* — William J Royer
(74) *Attorney, Agent, or Firm* — Patterson & Sheridan, LLP

(57) ABSTRACT

An image forming apparatus includes a developing unit attachment part to which developing units are to be attached, each of the developing units being associated with a first criteria for performing developer refreshing and a second criteria for performing developer refreshing, wherein the second criteria is defined so as to be met prior to the first criteria, and a controller configured to control a timing of developer refreshing executed for each of the developing units according to the first and second criteria values thereof. When the first criteria for performing developer refreshing is met for at least one of the developing units, the controller causes developer refreshing to be performed for all developing units whose first or second criteria is met.

15 Claims, 8 Drawing Sheets

FIG.6

| | Developing unit EY | | Developing unit EM | | Developing unit EC | | Developing unit EK | |
|---|---|---|---|---|---|---|---|---|
| | number of the sheets printed with low coverage | cumulative driving time | number of the sheets printed with low coverage | cumulative driving time | number of the sheets printed with low coverage | cumulative driving time | number of the sheets printed with low coverage | cumulative driving time |
| First execution criteria value V1 | 2000 | 10 hour | 2000 | 10 hour | 2000 | 10 hour | 1900 | 9.5 hour |
| Second execution criteria value V2 | 1950 | 9.8 hour | 1950 | 9.8 hour | 1950 | 9.8 hour | 1850 | 9.3hour |

FIG.7

| | Developing unit EY | | Developing unit EM | | Developing unit EC | | Developing unit EK | |
|---|---|---|---|---|---|---|---|---|
| | number of the sheets printed with low coverage | cumulative driving time | number of the sheets printed with low coverage | cumulative driving time | number of the sheets printed with low coverage | cumulative driving time | number of the sheets printed with low coverage | cumulative driving time |
| First execution criteria value V1 | 2000 | 10 hour | 2000 | 10 hour | 2000 | 10 hour | 1900 | 9.5 hour |
| Second execution criteria value V2 | 1950 | 9.8 hour | 1950 | 9.8 hour | 1950 | 9.8 hour | 1850 | 9.3hour |
| | | | | | | | | |
| Acquired developer deterioration factor | 2200 | 10.5 hour | 1900 | 8.5 hour | 1700 | 9 hour | 1700 | 8.5 hour |
| | | | | | | | | |
| Perform refreshing ? | **Yes** | | No | | No | | No | |

FIG.8

| | Developing unit EY | | Developing unit EM | | Developing unit EC | | Developing unit EK | |
|---|---|---|---|---|---|---|---|---|
| | number of the sheets printed with low coverage | cumulative driving time | number of the sheets printed with low coverage | cumulative driving time | number of the sheets printed with low coverage | cumulative driving time | number of the sheets printed with low coverage | cumulative driving time |
| First execution criteria value V1 | 2000 | 10 hour | 2000 | 10 hour | 2000 | 10 hour | 1900 | 9.5 hour |
| Second execution criteria value V2 | 1950 | 9.8 hour | 1950 | 9.8 hour | 1950 | 9.8 hour | 1850 | 9.3hour |
| Acquired developer deterioration factor | 2200 | 10.5 hour | 1970 | 8.5 hour | 1700 | 9.9 hour | 1700 | 8.5 hour |
| Perform refreshing ? | **Yes** | | **Yes** | | **Yes** | | No | |

IMAGE FORMING APPARATUS AND METHOD FOR CONTROLLING DEVELOPER REFRESHING PROCESS THEREIN

TECHNICAL FIELD

This specification relates to a control technology for refreshing of developer in developing units.

BACKGROUND

A conventional image forming apparatus typically includes a developer refreshing mechanism that supplies new developer consisting of toner and carrier particles, and discharges old developer, to maintain the quality of the developer.

In an image forming apparatus that uses a plurality of developing units for an image forming process, the above-described developer refreshing process needs to be carried out for each of the developing units. The developer refreshing mechanism carries out the developer refreshing process for a developing unit when a predetermined condition is met, e.g., when the number of sheets printed using toner in the developer supplied by the developing unit reaches a predetermined threshold value.

Since the utilization rate of the developer in each of the developing units varies, the developer refreshing mechanism carries out the developer refreshing process for each of the different developing units independently. However, if the utilization rate of the developer in the developing units is similar, the timings for carrying out the refreshing process for the developing units may be close to each other. In such a situation, the refreshing process for one developing unit may start during or just after the refreshing process for another developing unit. Since the image forming function of the image forming apparatus cannot be used during the refreshing process, the user of the image forming apparatus may need to wait a long time until the refreshing processes for all of the developing units have completed.

SUMMARY

An image forming apparatus, according to an embodiment, includes a developing unit attachment part to which developing units are to be attached, each of the developing units being associated with a first criteria for performing developer refreshing and a second criteria for performing developer refreshing, wherein the second criteria is defined so as to be met prior to the first criteria, and a controller configured to control a timing of developer refreshing executed for each of the developing units according to the first and second criteria values thereof. When the first criteria for performing developer refreshing is met for at least one of the developing units, the controller causes developer refreshing to be performed for all developing units whose first or second criteria is met.

According to another embodiment, a method for controlling refreshing process in an image forming apparatus having a developing unit attachment part to which developing units are attached, each of the developing units being associated with a first criteria for performing developer refresh and a second criteria for performing developer refresh, wherein the second criteria is defined so as to be met prior to the first criteria, includes controlling a timing of developing refreshing executed for each of the developing units according to the first and second criteria values thereof. When the first criteria for performing developer refresh is met for at least one of the developing units, developer refreshing is performed for all developing units whose first or second criteria is met.

DESCRIPTION OF THE DRAWINGS

FIG. 6 is a table showing criteria values for executing the developer refreshing process for each of a plurality of developing units.

FIG. 7 is a table showing criteria values for executing the developer refreshing process for each of a plurality of developing units, and a first example of acquired values compared against the criteria values.

FIG. 8 is a table showing criteria values for executing the developer refreshing process for each of a plurality of developing units, and a second example of acquired values compared against the criteria values.

DETAILED DESCRIPTION

Embodiment of the present invention is explained below with reference to the accompanying drawings.

Figure 1:
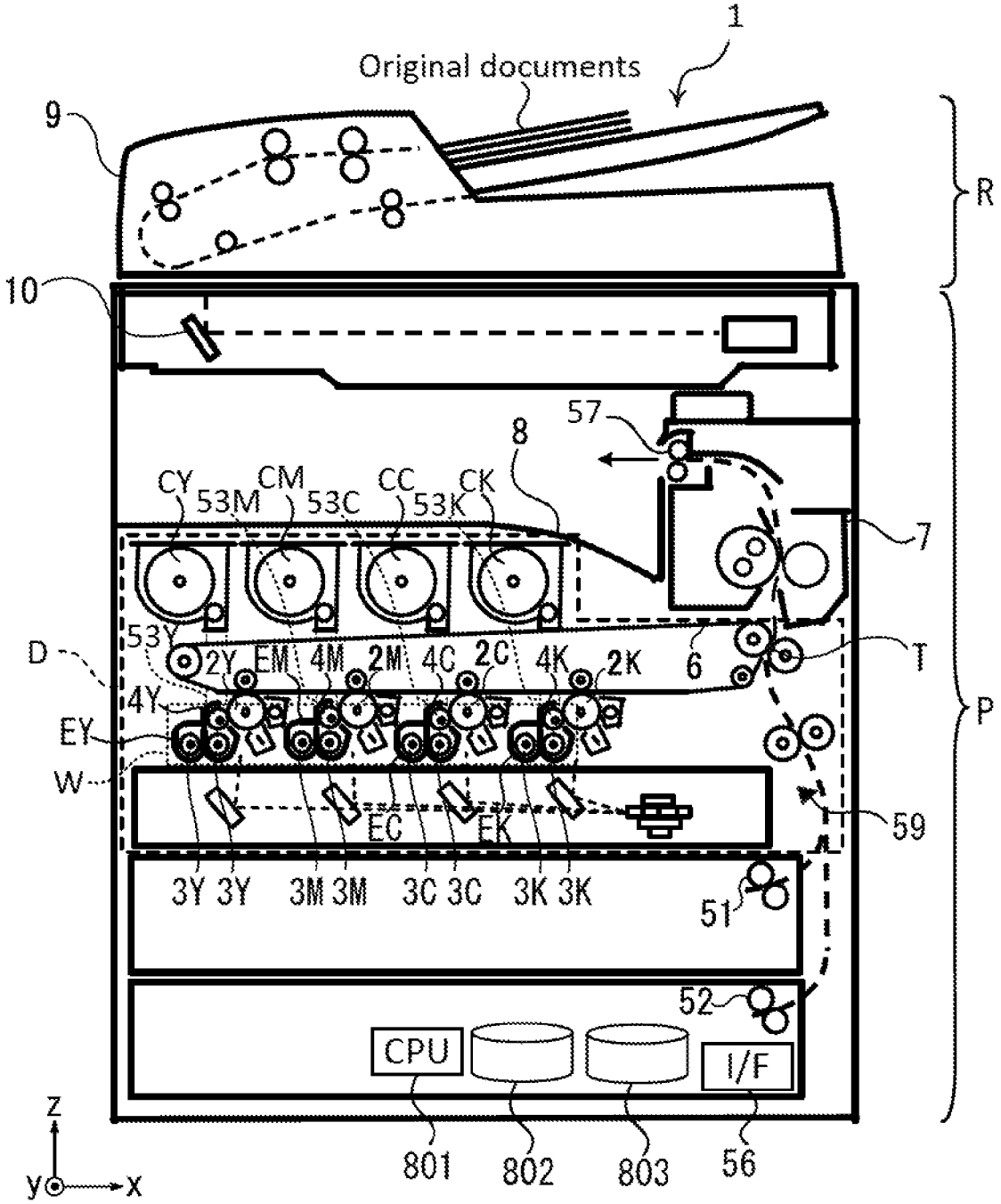
FIG. 1 is a vertical cross-sectional view of an image forming apparatus in which embodiments may be carried out.
Figure 2:
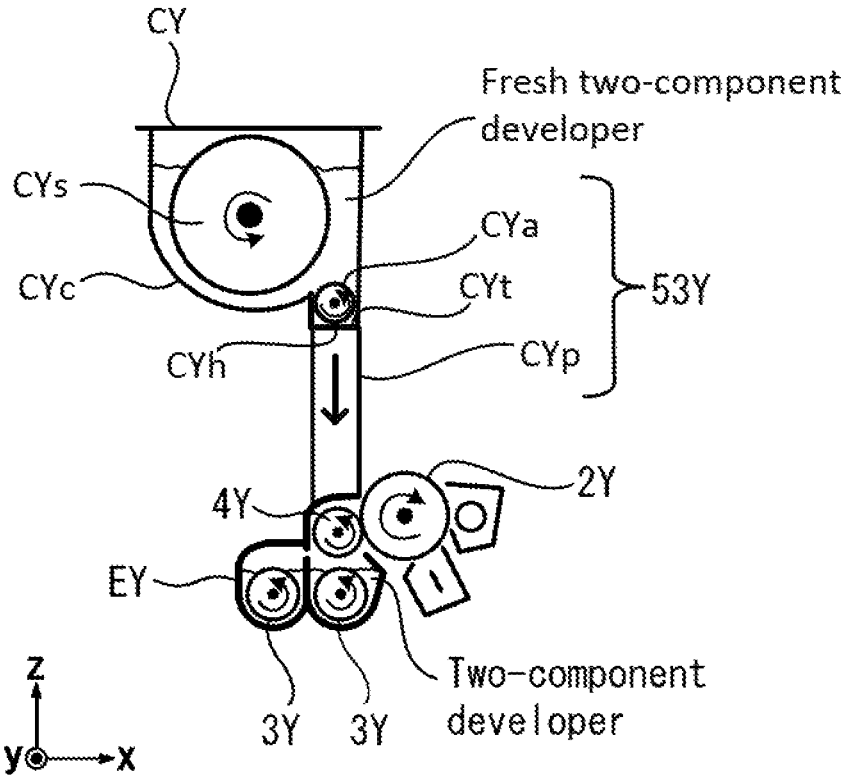
FIG. 2 is a vertical cross-sectional view of a mechanism for supplying fresh developer to the developing unit.
Figure 3:
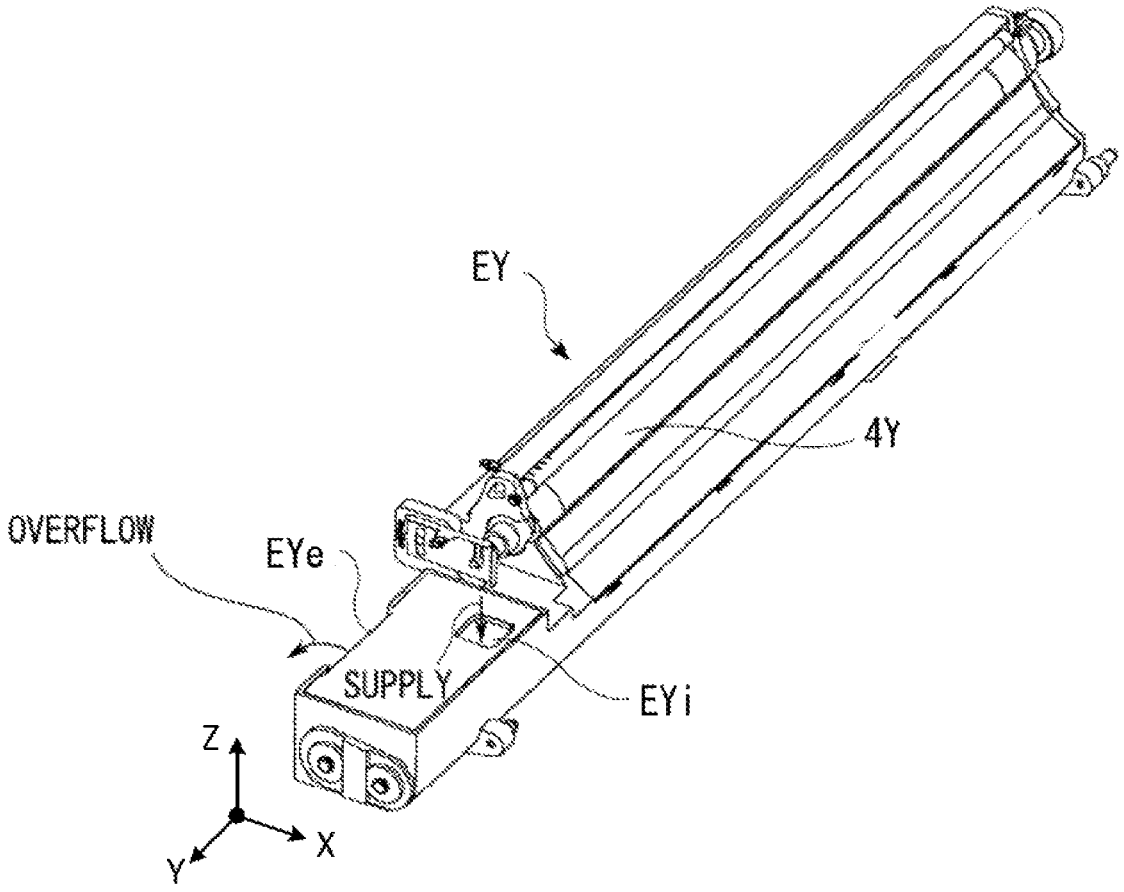
FIG. 3 is a perspective view of the developing unit in the image forming apparatus.
Figure 4:
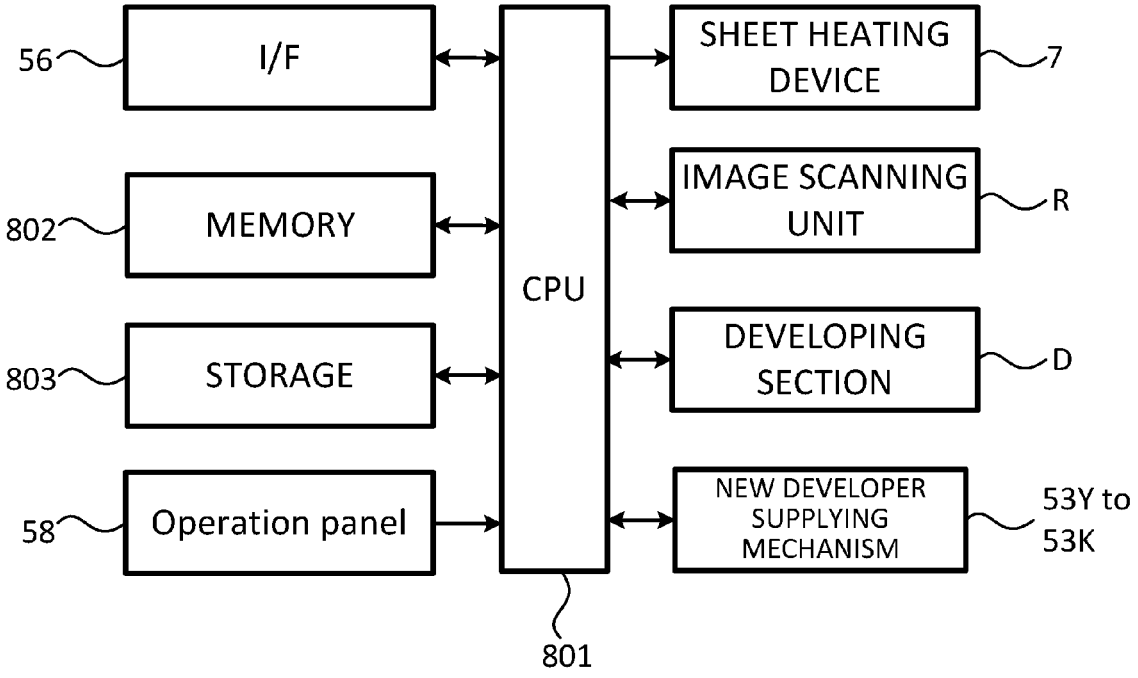
FIG. 4 is a block diagram of components of the image forming apparatus.

Referring now to the drawings, an image forming apparatus will be described. FIG. 1 is a vertical cross-sectional view of an image forming apparatus 1 (e.g., MFP: Multi-Function Peripheral), in which embodiments may be practiced. FIG. 2 is a vertical cross-sectional view of a mechanism for supplying fresh developer to a developing unit. FIG. 3 is a perspective view of the developing unit in the image forming apparatus 1. FIG. 4 is a block diagram of components of the image forming apparatus 1.

As shown in FIG. 1, the image forming apparatus 1 includes, for example, an image scanning unit R and an image forming unit P. The image scanning unit R is configured to scan an image from a sheet-type original or a book-type original and acquire image data that is used in forming an image on a sheet. The image forming unit P is configured to form an image on a sheet such as a printing paper or a film on the basis of the image data that the image scanning unit R acquires from the original or image data transmitted from an external device. A plurality of developing units are attached to a developing unit attachment part W in the image forming apparatus 1.

A flow of an image forming operation carried out by the image forming apparatus 1 will be described using a multi-color copying example.

First, the image scanning unit R scans an image of an original placed at an image scanning position by an Auto Document Feeder (ADF) 9 or placed manually thereat by the user, for image scanning to be performed by a scanning optical system 10.

Second, the image forming unit P forms electrostatic latent images on photoconductive surfaces of photoconductive drums (2Y, 2M, 2C, 2K) for yellow (Y), magenta (M), cyan (C), and black (K), on the basis of an operation input made through an operation panel 58 (see FIG. 4) by the user and the image data acquired by the image scanning unit R. Subsequently, toner which is stirred with carrier by mixers (3Y, 3M, 3C, 3K) in developing units (EY, EM, EC, EK) is supplied to the photoconductive surfaces of the photoconductive drums (2Y, 2M, 2C, 2K) from developing rollers (4Y, 4M, 4C, 4K) to form toner images on the photoconductive surfaces. The toner images formed on the photoconductor surfaces are transferred to a surface of a rotating intermediate transfer belt 6, and the rotating intermediate transfer belt 6 transports the toner images to a transfer position T where the toner images are transferred onto a sheet.

In parallel, the sheet is picked up from a cassette by one of pickup rollers 51 and 52 and transferred to the transfer position T by a plurality of roller pairs.

Within the image forming apparatus 1, a developing section D includes the photoconductive drums 2Y to 2K, the developing rollers 4Y to 4K, the mixers 3Y to 3K, the rotating intermediate transfer belt 6, and the plurality of roller pairs. Also, as illustrated herein, the developing unit EY includes the developing roller 4Y and the mixers 3Y, the developing unit EM includes the developing roller 4M and the mixers 3M, the developing unit EC includes the developing roller 4C and the mixers 3C, and the developing unit EK includes the developing roller 4K and the mixers 3K. When the sheet is transferred to the transfer position T from the cassette, a media sensor 59 detects a physical characteristic of the sheet, e.g., a thickness of the sheet, a color of the surface of the sheet, or a reflectivity of the surface of the sheet. From the physical characteristic of the sheet, the sheet type may be determined by a control unit, which in the embodiments illustrated herein, is a programmed processor (e.g., CPU 801 shown in FIG. 4).

After the toner images are transferred to the sheet, the sheet is supplied to a sheet heating device 7. The sheet heating device 7 carries out a fixing process based on at least the type of a sheet, which is determined by the control unit based on the physical characteristic of the sheet detected by the media sensor 59 or manually set by the user through the operation panel 58, to fix the developer images to the sheet.

The sheet having an image fixed thereon is conveyed through a conveyance path by a plurality of conveying roller pairs and is discharged onto a discharge tray 8 by discharging rollers 57.

A new developer supplying mechanism 53Y is arranged for the developing unit EY and includes an auger CYa, transport path CYt having a replenishment opening CYh, and a communication pipe CYp to convey new (unused) developer to the developing unit EY from a developer tank CY which contains two-component developer including yellow color toner and carrier (FIG. 2).

In detail, the developer tank CY includes a casing CYc having a transport path CYt at a bottom thereof, an agitating member CYs (e.g. combination of a coil-shaped agitator and a crank-shaped paddle) disposed in the casing CYc which is driven by a cartridge motor (not shown) around the y-axis and a transporting member CYa (auger) driven by the cartridge motor around the y-axis in the transport path CYt.

The new developer in the developer tank CY is agitated by the agitating member CYs. The transporting member CYa transports the developer agitated by the agitating member CYs to a discharge port (replenishment opening) CYh. The discharge port (replenishment opening) CYh is in fluid communication with a supply port EYi of the developing unit EY through a communication pipe CYp.

After the developer enters the developing unit EY through the supply port EYi, the developer is transported in the y-axis direction towards the distal end of the developing unit EY shown in FIG. 3 by mixers 3Y and is circulated around the distal end of the developing unit EY and then back towards the proximal end of the developing unit EY. At the proximal end of the developing unit EY, the developer overflows to be discharged through a discharge port EYe provided in the casing of the developing unit EY by an amount of new developer supplied to the developing unit EY through the supply port EYi. Consequently, an amount of the developer in the developing unit EY is maintained constant and, at the same time, the old and deteriorated developer in the developing unit EY is replaced with the new developer. If no new developer was supplied to the developing unit EY, the developer is circulated around the proximal end of the developing unit EY and is transported toward the distal end of the developing unit EY once more.

New developer supplying mechanisms 53M, 53C, 53K, shown in FIG. 1, are also arranged for each of the developing units EM, EC, EK in the same manner as new developer supplying mechanism 53Y to convey new (unused) developer to its developing unit from a respective one of developer tanks CM, CC, CK.

In further embodiments, the image forming apparatus 1 carries out an image forming process using decolorable colorants, which are decolored when heated above a decoloring temperature thereof.

The image forming apparatus 1 further includes a processor 801 such as CPU (Central Processing Unit), memory 802 and storage 803. As shown in FIG. 4, the components of the image forming apparatus 1 are connected through a bus. The image forming apparatus 1 is connected to the external device through a communication I/F 56.

The memory 802 is a semiconductor memory, for example. The memory 802 includes a ROM (Read Only Memory) that stores a control program of the processor 801 and a RAM (Random Access Memory) that provides a temporary operation space for the processor 801.

The processor 801 controls the operation of the image forming unit P, the image scanning unit R, a developing section D, the sheet heating device 7, the communication I/F 56, new developer supplying mechanisms 53Y to 53K, and other units of the image forming apparatus 1, which is described in this embodiment, by executing a control program or the like stored in the memory 802 or the storage 803. Further, the processor 801 is programmed to perform various image processing functions. In alternative embodiments, the processor 801 may be replaced by an ASIC (Application Specific Integrated Circuit) or programmable logic devices such as FPGA (Field Programmable Gate Array) that implements some or all of the functions of the image forming apparatus 1.

The storage 803 stores application programs and the OS in a non-volatile manner. The application programs include a program that executes the functions of the image forming apparatus 1, including a copy function, a print function, and a scanner function. Further, the storage 803 stores image data generated when the image scanning unit R reads a copy or data acquired from an external device connected to the communication I/F 56 through a network.

Examples of the storage 803 include a magnetic-storage device, such as a hard disk drive, an optical storage device, a semiconductor storage device (flash memory or the like), or a combination of these devices.

In the image forming apparatus 1, deteriorated developer is discharged by overflowing when the new developer supplying mechanisms 53Y to 53K supply new developer from the developer tanks CY to CK to the developing units EY to EK. In addition, toner in the deteriorated developer may be discharged by transferring a toner image having a predetermined pattern onto a sheet.

In the embodiments, the developing section D and the new developer supplying mechanisms 53Y to 53K correspond to a refreshing mechanism, and the refreshing mechanism is provided for each of the developing units EY to EK. The refreshing mechanism performs the refreshing of the developer in each of the plurality of developing units attached to the developing unit attachment part W.

Figure 5:
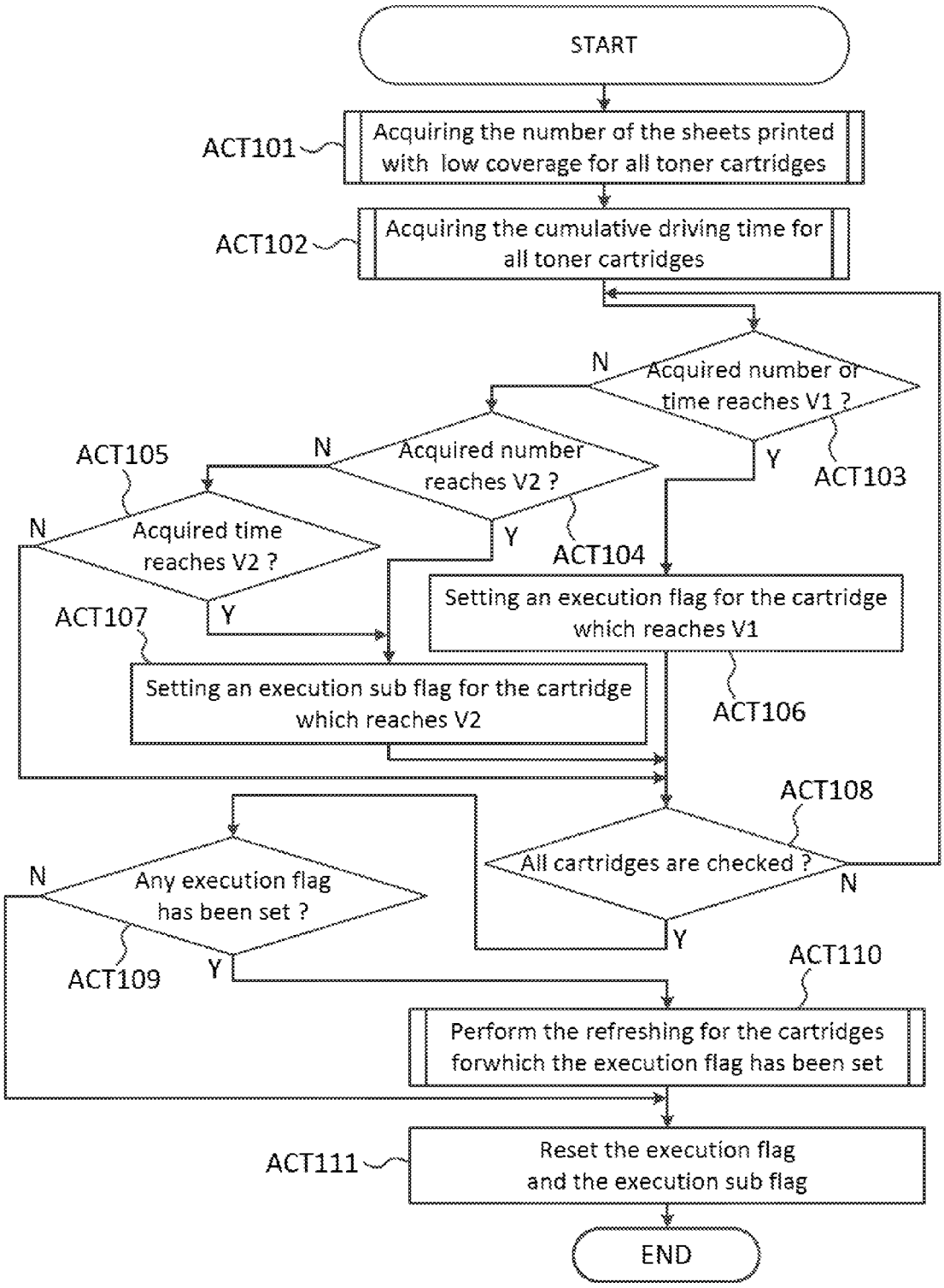
FIG. 5 is a flow chart of a developer refreshing process according to an embodiment.

FIG. 5 is a flow chart of a developer refreshing process according to an embodiment.

In general, the processor 801 determines the deterioration of the developer in each of the developing units EY to EK based on, for example, the number of sheets printed with low coverage (defined below) and a cumulative driving time (elapsed time) of each of the mixers 3Y to 3K. The processor 801 acquires the number of sheets printed with low coverage and the cumulative driving time from print jobs sent from external network devices such as personal computers, and the storage 803 which stores detailed logs of processes carried out in the image forming apparatus 1.

As used herein, low coverage printing is printing whose print coverage rate on a printable area of a sheet is lower than a predetermined threshold value. The print coverage rate equals the total number of dots to be printed on a sheet divided by the total number of printable dots on the sheet.

In FIG. 5, with regard to each of developing units EY to EK that are attached to the developing unit attachment part W, the processor 801 acquires the number of sheets printed with low coverage (ACT101). The number of sheets printed with low coverage acquired by the processor 801 is equal to the total number of the sheets printed with low coverage since the initial installation of developing unit in the image forming apparatus 1 or since the last refreshing process.

Further, the processor 801 acquires the cumulative driving time of the developing unit since the initial installation of developing unit in the image forming apparatus 1 or since the last refreshing thereof (ACT102).

In FIG. 5, the processor 801 acquires the cumulative driving time after acquiring the number of sheets printed with low coverage. However, the order of the steps can be reversed. Also, the processor 801 may perform the steps at the same time.

Accordingly, the processor 801 acquires the number of sheets printed with low coverage and the cumulative driving time as developer deterioration factors, from which it can determine a degree of deterioration of developer contained in each of the developing units EY to EK.

In this embodiment, each of the plurality of developing units EY to EK is associated with a first execution criteria value V1 and a second execution criteria value V2 for each of the developer deterioration factors, where the two execution criteria values are set for each of the developing units EY to EK so that the second execution criteria value V2 is met prior to the first execution criteria value V1.

FIG. 6 is a table showing execution criteria values stored in the storage 803, which are set for each of the developing units EY to EK.

In detail, as shown in FIG. 6, both of the first execution criteria value V1 and the second execution criteria value V2 are set for each of the developer deterioration factors. In FIG. 7, one example of the developer deterioration factors (the number of sheets printed with low coverage and the cumulative driving time) acquired by the processor 801 are shown.

As shown in FIG. 6, for the cumulative driving time, the second execution criteria value V2 is less than the first execution criteria value V1. Thus, the cumulative driving time will satisfy the second execution criteria value V2 before it satisfies the first execution criteria value V1. Similarly, for the number of sheets printed with low coverage, the second execution criteria value V2 is less than the first execution criteria value V1. Thus, the number of sheets printed with low coverage will satisfy the second execution criteria value V2 before it satisfies the first execution criteria value V1.

If the number of sheets printed with low coverage or the cumulative driving time acquired by the processor 801 for the developing unit EY reaches the first execution criteria value V1 set for the developing unit EY (ACT103, Yes), the processor 801 sets an execution flag in the storage 803 for refreshing the developing unit EY (ACT106).

On the other hand, if both the number of sheets printed with low coverage and the cumulative driving time acquired by the processor 801 for the developing unit EY do not reach the first execution criteria value V1 set for the developing unit EY (ACT103, No), the processor 801 determines whether the number of sheets printed with low coverage acquired by the processor 801 for the developing unit EY reaches the second execution criteria value V2 set for the developing unit EY (ACT104).

If the number of sheets printed with low coverage acquired by the processor 801 for the developing unit EY reaches the second execution criteria value V2 set for the developing unit EY (ACT104, Yes), the processor 801 sets an execution sub flag in the storage 803 for refreshing the developing unit EY (ACT107).

Next, if the number of sheets printed with low coverage acquired by the processor 801 for the developing unit EY does not reach the second execution criteria value V2 set for the developing unit EY (ACT104, No), the processor 801 determines whether the cumulative driving time acquired by the processor 801 for the developing unit EY reaches the second execution criteria value V2 set for the developing unit EY (ACT105).

If the cumulative driving time acquired by the processor 801 for the developing unit EY reaches the second execution criteria value V2 set for the developing unit EY (ACT105, Yes), the processor 801 sets an execution sub flag in the storage 803 for refreshing the developing unit EY (ACT107).

If the cumulative driving time acquired by the processor 801 for the developing unit EY does not reach the second execution criteria value V2 set for the developing unit EY (ACT105, No) or after the setting of the execution flag or the execution sub flag (ACT106, ACT107), the processor 801 determines whether the above determination processes ACT 103 to ACT 107 are done for all developing units (ACT108). Thus, the processor 801 repeats this series of operations until the processor 801 finishes the determination of the deterioration of developers of all of the developing units EY to EK.

Subsequently, the processor 801 checks whether at least one execution flag has been set (ACT109). If at least one execution flag has been set (ACT109, Yes), the processor 801 causes the developing section D and the new developer supplying mechanisms 53Y to 53K to perform developer refreshing (ACT110). In particular, the processor 801 causes the developing section D and the new developer supplying mechanisms 53Y to 53K to perform developer refreshing for all developing units that have either the execution flag or the execution sub flag set.

If no execution flag has been set (ACT109, no), the processor 801 resets the flags which has been set in the storage 803 (ACT111).

In the case of the example in FIG. 7, since the developer deterioration factors acquired by the processor 801 (here, the number of sheets printed with low coverage: 2200 sheets, the cumulative driving time: 10.5 hours) reach only the first execution criteria values V1 (here, 2000 sheets, 10 hours) set for the developing unit EY, the processor 801 causes the developing section D and the new developer supplying mechanism 53Y to perform developer refreshing only for the developing unit EY.

That is, when the acquired developer deterioration factor for one of the developing units (here, developing unit EY) reaches the first execution criteria value V1, and the acquired developer deterioration factors for the other developing units have not even reached the second execution criteria value V2, the controller 801 causes the developing section D and the new developer supplying mechanisms 53Y to 53K (refreshing unit) to perform the refreshing of only the developing unit EY.

On the other hand, in the case of the example in FIG. 8, when the developer deterioration factors acquired by the processor 801 for different developing units (here, developing units EY, EM, and EC) reach either the first execution criteria value V1 or the second execution criteria value V2, i.e., (2000 sheets, 10 hours) for the developing unit EY, 1950 sheets for the developing unit EM, and 9.8 hours for the developing unit EC, the processor 801 causes the developing section D and the new developer supplying mechanisms 53Y to 53K to perform developer refreshing not only for the developing unit EY but also for the developing units EM and EC.

That is, when the acquired developer deterioration factors reach not only the first execution criteria value V1 but also at least one of the second execution criteria value V2, the processor 801 causes the developing section D and the new developer supplying mechanisms 53Y to 53K to perform the refreshing of developing units which reach the second execution criteria value V2 together with the refreshing of a developing unit which reaches the first execution criteria value V1.

Accordingly, it is possible to carry out the developer refreshing process for the developing units in parallel even in cases where the capacity of the developer and the developer utilization rate of the developing units are different. In addition, it is known that the developer in a larger capacity developing unit tends to be deteriorated earlier than a developer in a smaller capacity developing unit. Therefore, where the capacity of the developer of the developing unit EK is larger than the capacity of the developer of the other developing units EY to EC, as shown in FIG. 6, the start timing of the refreshing determined by the second execution criteria value V2 set for developing unit EK is earlier than the start timing of the refreshing determined by the second execution criteria values V2 set for the other developing units EY to EC.

For the same reason, as shown in FIG. 6, the start timing of the refreshing determined by the first execution criteria value V1 set for the developing unit EK is earlier than the start timing of the refreshing determined by the first execution criteria value V1 set for the other developing units EY to EC.

Further, for the same reason, i.e., the larger capacity of the developing unit EK relative to the other developing units EY to EC, the processor 801 may cause the developing section D and the new developer supplying mechanisms 53Y to 53K to perform the refreshing so that a developer exchanging amount of the developing unit EK to be larger than a developer exchanging amount of the other developing units EY to EC.

In the flow chart of FIG. 5, the refreshing of the developing unit which reaches the first execution criteria value V1 and the developing unit which reaches the second execution criteria value V2 are performed at the same time (ACT110). However, the processor 801 may cause the developing section D and the new developer supplying mechanisms 53*y* to 53K to perform the refreshing of the plurality of developing units (here, developing units EM and EC in the example of FIG. 8) which reach the plurality of the second execution criteria values V2 after finishing the refreshing of the developing unit (here, developing unit EY in the example of FIG. 8) which reaches the first execution criteria value V1.

According to this embodiment, by arranging the timings for the refreshing of a plurality of developing units to be close each other, it is possible to prevent long wait times for completion of refreshing processes for a plurality of developing units.

In the above embodiment, the developing section D can perform a multi-color image forming process onto a sheet using multiple colorants. However, it is possible to apply the present invention to an image forming apparatus which uses mono-color colorant (for example, black non-decolorable toner and black decolorable toner) to form an image on a sheet.

The present invention can be carried out in various forms without departing from main characteristics thereof. The embodiment is merely exemplar in every aspect and should not be limitedly interpreted. The scope of the present invention is indicated by the scope of claims. The text of the specification does not restrict the scope of the invention. All variations and various improvements, alterations, and modifications belonging to the scope of equivalents of the scope of claims are within the scope of the present invention.

What is claimed is:

1. An image forming apparatus, comprising:

a developing unit attachment part to which developing units are to be attached, each of the developing units being associated with a first criteria for performing developer refreshing and a second criteria for performing developer refreshing, wherein the second criteria is defined so as to be met prior to the first criteria; and a controller configured to control a timing of developer refreshing executed for each of the developing units according to the first and second criteria values thereof, wherein when the first criteria for performing developer refreshing is met for at least one of the developing units, the controller causes developer refreshing to be performed for all developing units whose first or second criteria is met.

2. The apparatus according to claim 1, further comprising:

a pipe connecting a discharge port of a developer tank to a supply port of the developing unit; and rotary members inside the developing unit that are configured to transport the developer supplied through the supply port to a discharge port, wherein the discharge port is formed on a side wall of the developing unit so that an amount of the developer discharged through the discharge port is about equal to an amount of the developer supplied through the supply port.

3. The apparatus according to claim 1, wherein each of the first criteria and the second criteria is the number of sheets printed with a print coverage rate which is lower than a predetermined threshold value, and the print coverage rate is calculated by dividing the total number of dots to be printed on a sheet by the total number of printable dots on the sheet.

4. The apparatus according to claim 1, wherein the developing unit includes a rotary member to stir and transport the developer in the developing unit, and each of the first criteria and the second criteria is a cumulative driving time of the rotary member.

5. The apparatus according to claim 1, wherein developer refreshing for all the developing units whose first or second criteria is met is carried out at the same time.

6. The apparatus according to claim 1, wherein developer refreshing for all the developing units whose first or second criteria is met is carried out at different times.

7. The apparatus according to claim 1, wherein the first and second criteria values set for a first developing unit having a first capacity are each less than the first and second criteria values set for a second developing unit having a second capacity that is smaller than the first capacity.

8. The apparatus according to claim 7, wherein the controller is further configured to execute developer refreshing so that a developer exchanging amount for the first developing unit is larger than a developer exchanging amount for the second developing unit.

9. A method for controlling refreshing process in an image forming apparatus having a developing unit attachment part to which developing units are attached, each of the developing units being associated with a first criteria for performing developer refreshing and a second criteria for performing developer refreshing, wherein the second criteria is defined so as to be met prior to the first criteria, comprising:

controlling a timing of developer refreshing executed for each of the developing units according to the first and second criteria values thereof, wherein when the first criteria for performing developer refreshing is met for at least one of the developing units, developer refreshing is performed for all developing units whose first or second criteria is met.

10. The method according to claim 9, wherein each of the first criteria and the second criteria is the number of sheets printed with a print coverage rate which is lower than a predetermined threshold value, and the print coverage rate is calculated by dividing the total number of dots to be printed on a sheet by the total number of printable dots on the sheet.

11. The method according to claim 9, wherein the developing unit includes a rotary member to stir and transport a developer in the developing unit, and each of the first criteria and the second criteria is a cumulative driving time of the rotary member.

12. The method according to claim 9, wherein developer refreshing for all the developing units whose first or second criteria is met is carried out at the same time.

13. The method according to claim 9, wherein developer refreshing for all the developing units whose first or second criteria is met is carried out at different times.

14. The method according to claim 9, wherein the first and second criteria values set for a first developing unit having a first capacity are each less than the first and second criteria values set for a second developing unit having a second capacity that is smaller than the first capacity.

15. The method according to claim 14, further comprising:

executing the developer refreshing so that a developer exchanging amount for the first developing unit is larger than a developer exchanging amount for the second developing unit.

* * * * *